US010661581B2

(12) United States Patent
Muramatsu et al.

(10) Patent No.: US 10,661,581 B2
(45) Date of Patent: May 26, 2020

(54) INK JET RECORDING APPARATUS

(71) Applicant: Konica Minolta Inc., Tokyo (JP)

(72) Inventors: Takashi Muramatsu, Hachioji (JP); Mitsuo Kaburagi, Hachioji (JP); Masashi Ikeda, Koganei (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 16/094,395

(22) PCT Filed: May 11, 2017

(86) PCT No.: PCT/JP2017/017854
§ 371 (c)(1),
(2) Date: Oct. 17, 2018

(87) PCT Pub. No.: WO2017/203991
PCT Pub. Date: Nov. 30, 2017

(65) Prior Publication Data

US 2019/0126638 A1 May 2, 2019

(30) Foreign Application Priority Data

May 27, 2016 (JP) ..... 2016-106706

(51) Int. Cl.
*B41J 11/00* (2006.01)
*B41J 13/08* (2006.01)

(52) U.S. Cl.
CPC ..... *B41J 11/002* (2013.01); *B41J 13/08* (2013.01); *B41J 11/0015* (2013.01); *B41J 11/0085* (2013.01)

(58) Field of Classification Search
CPC ... B41J 11/002; B41J 11/0085; B41J 11/0015; B41J 13/08; B41J 2/2114; B41J 11/00
See application file for complete search history.

(56) References Cited

U.S. PATENT DOCUMENTS

2008/0211895 A1 9/2008 Nishino
2016/0142571 A1* 5/2016 Smeyers ..... H04N 1/00652 358/1.12

FOREIGN PATENT DOCUMENTS

JP 2007030217 A 2/2007
JP 2009241277 A 10/2009
(Continued)

OTHER PUBLICATIONS

Written Opinion of the International Searching Authority dated Jun. 20, 2017 from the correstponding International Application No. PCT/JP2017/017854 and English translation.
(Continued)

*Primary Examiner* — Kristal Feggins
(74) *Attorney, Agent, or Firm* — Lucas & Mercanti, LLP

(57) ABSTRACT

An ink jet recording apparatus contains a conveyer which conveys a recording medium, the conveyer having conveyance members on which the recording medium is mounted; a recorder which jets ink onto the recording medium being conveyed; and a fixer which fixes the ink landed on the recording medium. The ink is curable by a predetermined energy ray. The fixer irradiates the ink on the recording medium with the predetermined energy ray. The conveyer passes the recording medium for conveyance between the conveyance members and moves the recording medium in respective planes by movement of the conveyance members.

20 Claims, 4 Drawing Sheets

(56) References Cited

FOREIGN PATENT DOCUMENTS

| | | | |
|---|---|---|---|
| JP | 2014000724 | A | 1/2014 |
| JP | 2015016627 | A | 1/2015 |
| JP | 2015047798 | A | 3/2015 |
| WO | 2006098143 | A1 | 9/2006 |

OTHER PUBLICATIONS

International Search Report dated Jun. 20, 2017 for PCT/JP2017/017854 and English translation.

CNIPA, Office Action for the corresponding Chinese patent application No. 201780032458.7, dated Oct. 23, 2019, with English translation (17 pages).

* cited by examiner

INK JET RECORDING APPARATUS

CROSS REFERENCE TO RELATED APPLICATION

This Application is a 371 of PCT/JP2017/017854 filed on May 11, 2017 which, in turn, claimed the priority of Japanese Patent Application No. 2016-106706 filed on May 27, 2016, both applications are incorporated herein by reference.

TECHNOLOGICAL FIELD

The present invention relates to an ink jet recording apparatus.

BACKGROUND ART

Ink jet recording apparatuses record an image by jetting ink from nozzles to land it on a recording medium. Such ink jet recording apparatuses can record image on a variety of recording media including heavy paper, cardboard, resin materials such as acrylic plates, fabric and the like as well as normal paper. To convey a recording medium in ink jet recording apparatuses, typically, an endless belt or the like is used to convey it in a plane, or a cylindrical drum is used to revolve it. In particular, when it is desired not to fold or bend a recording medium or it is difficult to fold or bend the material of a recording medium, an endless belt or the like is used to convey the recording medium in a plane.

In ink jet recording apparatuses, various types of techniques are used to surely fix liquid ink landed on a recording medium onto the recording medium. One of such techniques involves using a UV-curable ink and irradiating a recording medium on which the ink has been landed with ultraviolet ray so as to surely solidify and fix the ink onto the recording medium. However, a problem with this technique is that the ultraviolet ray may leak in the process of recording or reading an image to negatively affect the recording or reading process of the image. Patent Document 1 discloses a technique of controlling ultraviolet ray emission for avoiding the negative influence on a reading process of a target image.

PRIOR ART DOCUMENT

Patent Document

Patent Document 1: JP 2015-016627A

SUMMARY OF THE INVENTION

Problem to be Solved by Invention

However, chemical reactions related to curing of ink by energy ray such as ultraviolet ray is associated with generation or absorption of heat, typically generation of heat. In addition to ultraviolet ray, a change in the amount of heat on a recording medium affects the temperature of another recording medium on the same conveyance member via the conveyance member, or an additional component for reducing such a change in the amount of heat affects the surrounding environment when it is operated. Since they affect the precision of landing ink on the recording medium or the properties of the landed ink, there is a problem of decreased image quality.

It is an object of the present invention to provide an ink jet recording apparatus that can record an image with favorable image quality more stably on a recording medium and that can fix it surely.

Means for Solving Problem

To achieve the abovementioned objects, the invention according to claim 1 includes:

a conveyer which conveys a recording medium, the conveyer having conveyance members on which the recording medium is mounted;

a recorder which jets ink onto the recording medium being conveyed; and a fixer which fixes the ink landed on the recording medium;

wherein the ink jetted from the recorder is curable by a predetermined energy ray, wherein the fixer irradiates the ink on the recording medium with the predetermined energy ray, and wherein the conveyer passes the recording medium for conveyance between the conveyance members and moves the recording medium in respective planes by movement of the conveyance members;

moves the recording medium mounted on a first conveyance member of the conveyance members in a predetermined first plane by a movement of the first conveyance member while the recording medium is opposed to an ink jetting surface of the recorder; and mounts the recording medium which has been moved by the first conveyance member onto a second conveyance member of the conveyance members and moves the recording medium in a predetermined second plane by a movement of the second conveyance member to pass the recording medium through an irradiation area of the predetermined energy ray of the fixer.

The invention according to claim 2 is the ink jet recording apparatus according to claim 1, further including:

a reader which reads a recording face of the recording medium opposed to the ink jetting surface, wherein the conveyer mounts the recording medium which has been moved by the movement of the second conveyance member onto a third conveyance member of the conveyance members and moves the recording medium in a predetermined third plane by a movement of the third conveyance member to pass the recording medium through a reading area of the reader.

The invention according to claim 3 is the ink jet recording apparatus according to claim 1 or 2, wherein the conveyer includes an adjuster which adjusts the position of the planes in which the recording medium is moved by the movement of the conveyance members.

The invention according to claim 4 is the ink jet recording apparatus according to any one of claims 1 to 3, wherein the planes in which the recording medium is moved by the movement of the conveyance members are flush in a single plane.

The invention according to claim 5 is the ink jet recording apparatus according to claim 4, wherein the recording medium is passed between the conveyance members in the single plane.

The invention according to claim 6 is the ink jet recording apparatus according to any one of claims 1 to 5, further including:

a medium feeder which sequentially feeds recording media with a specified size to the conveyer.

The invention according to claim 7 is the ink jet recording apparatus according to any one of claims 1 to 6, wherein the conveyer includes an anti-floating unit which prevents the mounted recording medium from floating from the conveyance members.

The invention according to claim 8 is the ink jet recording apparatus according to claim 7, wherein the anti-floating unit includes a suction unit which suctions and holds the recording medium on the conveyance members.

The invention according to claim 9 is the ink jet recording apparatus according to claim 8, wherein the conveyance members respectively include mounting surfaces on which the recording medium is mounted, and through openings that connect the mounting surfaces and opposite surfaces, and wherein the suction unit suctions air at the mounting surfaces from the opposite surfaces through the openings so as to hold the recording medium on the conveyance members.

The invention according to claim 10 is the ink jet recording apparatus according to any one of claims 7 to 9, wherein the anti-floating unit includes a roller that presses the recording medium against the conveyance members.

The invention according to claim 11 is the ink jet recording apparatus according to any one of claims 1 to 10, further including:

a temperature controller which controls a temperature of the recording medium before the recording medium is mounted on the first conveyance member.

The invention according to claim 12 is the ink jet recording apparatus according to any one of claims 1 to 11, further including:

a corona treatment unit which performs a corona treatment on the recording medium and which is disposed in an upstream in a conveyance direction of the recording medium with respect to a point where the recording medium is mounted on the first conveyance member.

The invention according to claim 13 is the ink jet recording apparatus according to any one of claims 1 to 12, wherein the conveyance members are constituted by respective individual endless belts.

The invention according to claim 14 is the ink jet recording apparatus according to claim 13, wherein at least a part of the endless belts is a steel belt.

Advantageous Effects of Invention

According to the present invention, the ink jet recording apparatus is advantageous in that it can record an image with suitable image quality on a recording medium more stably and fix it surely.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

EMBODIMENTS FOR CARRYING OUT INVENTION

Hereinafter, one or more embodiments of the present invention will be described with reference to the drawings. However, the scope of the invention is not limited to the disclosed embodiments.

Hereinafter, an embodiment of the present invention will be described based on the drawings.

Figure 1:
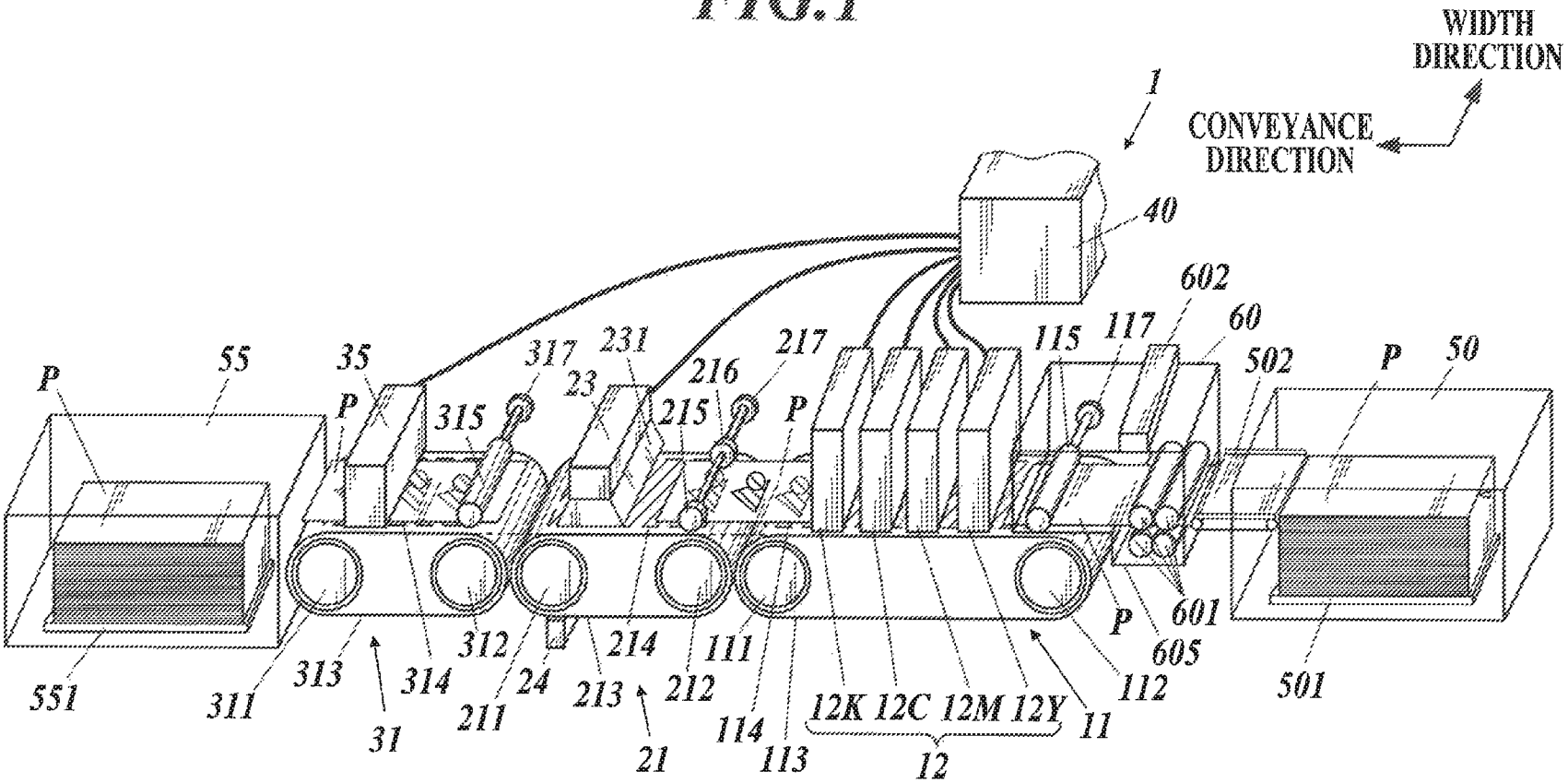
FIG. 1 is a schematic view of the overall configuration of the ink jet recording apparatus according to an embodiment of the present invention.

FIG. 1 is a schematic view of the overall configuration of an ink jet recording apparatus 1 according to the embodiment.

The ink jet recording apparatus 1 includes a medium feeder 50, a medium heater 60 (temperature adjuster), a first conveyer and a recorder 12, a second conveyer 21, a fixer 23 and a cooler 24, a third conveyer 31 and a reader 35, a medium ejector 55 and the like.

The medium feeder 50 includes a medium loader 501 and a positioner 502 and the like. The medium loader 501 includes a flat plate (tray) on which recording media P, which are cardboards with a specified size in the embodiment but are not particularly limited thereto, are loaded. The plate moves up and down according to the amount of recording media loaded so that the uppermost recording medium P is successively fed to the positioner 502 in an approximately horizontal direction.

The positioner 502 includes a guide or the like for positioning the recording medium P, particularly setting it in a predetermined position in the width direction perpendicular to the conveyance direction of the recording medium. The positioner 502 feeds the recording medium P to the first conveyer 11 in a suitable position at suitable timing.

The medium heater 60 heats the recording medium P while conveying it by nipping the recording medium P with heating rollers 601 from opposite sides and rotating them. The heating rollers 601, which include a coaxial medium heating element 611, heat the recording medium P by transferring heat from the heated surfaces of the heating rollers 601 to the recording medium P. The medium heating element 611 is constituted by an electric heating sheet that generates Joule heat from electric current.

A heating chamber 605 is provided over the heating rollers 601 and a part of the first conveyer 11. An air heating element 612 keeps the temperature in the heating chamber 605 constant so as to reduce the temperature variation in the recording medium P heated by the medium heating elements 611 to achieve an approximately uniform temperature. For example, the air heating element 612 is constituted by an infrared heater that emits infrared ray.

The first conveyer 11 includes a driving roller 111, a driven roller 112, and an endless conveyance belt 113 (first conveyance member, endless belt), a first suction holder 114, a pressing roller 115 (roller), a first pressing motor 117 and the like.

Figure 2:
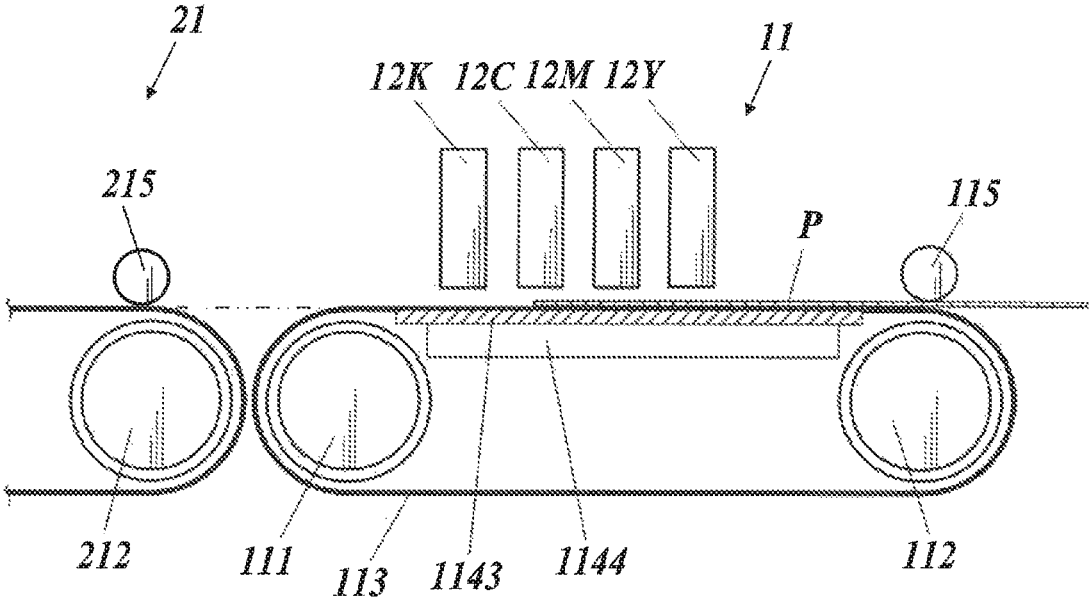
FIG. 2 is a schematic side view of the structure of a first conveyer and a second conveyer.

FIG. 2 is a schematic side view of the structure of the first conveyer 11 and the second conveyer 21.

In the illustrated example, the endless conveyance belt 113 is a steel belt. The conveyance belt 113 is suspended between the driving roller 111 and the driven roller 112 to circle (move) around them. After the recording medium P is fed from the medium heater 60 by the rotating heating rollers 601, it is mounted on a section of the outer surface (mounting surface for the recording medium P) of the conveyance belt 113 where the mounting surface moves horizontally (in a first plane) in an upward position. The recording medium P is then conveyed by circling movement of the conveyance belt 113. In this section, the recording medium P and the conveyance belt 113 (mounting surface) are opposed to the surfaces (ink jetting surfaces) of the head units 12Y, 12M, 12C and 12K of the recorder 12 in which ink is jetted from nozzles. The conveyance belt 113 has a number of through openings arranged in a predetermined pattern so that the air can flow from the mounting surface to the opposite surface. A moving amount (rotation) meter (not shown), which is an encoder (rotary encoder) in the embodiment, is provided in the first conveyer 11, e.g. at the driving shaft of the driving roller 111 (not limiting), so that the circling distance is measurable, although the embodiment is not particularly limited thereto.

As described above, the heating chamber 605 is disposed to cover an upstream part in the conveyance direction of the section where the recording medium P is mounted on the mounting surface of the conveyance belt 113. The recording medium P is mounted on the conveyance belt 113 inside the heating chamber 605. While the inside of the heating chamber 605 is visible through the wall in FIG. 1, it is not necessary that the inside is visible.

When the recording medium P is mounted onto the mounting surface of the conveyance belt 113, the pressing roller 115 is driven by a first pressing motor 117 to prevent (reduces) the recording medium P from floating up from the mounting surface so as to keep it in contact with the mounting surface and to move the recording medium P in the conveyance direction. The pressing roller 115 presses the recording medium P at such a strength that does not compress the recording medium P, or that does not irreversibly crush the core of a cardboard particularly in the embodiment. The rotation speed of the pressing roller 115 is controlled so that the moving speed of the surface is equal to the moving speed of the conveyance belt 113. The pressing roller 115 may not be rotary driven to actively rotate but be only rotated according to the movement of the recording medium P.

The first suction holder 114 holds the recording medium on the mounting surface. For example, the first suction holder 114 includes a support plate 1142 that supports the conveyance belt 113 having the mounting surface from the opposite surface, a first suction fan 1143 (suctioning unit) and the like. The first suction fan 1143 is disposed at the inside surrounded by the inner surface of the conveyance belt 113. The support plate 1142 has a number of permeable holes so that the air can flow from the mounting surface of the conveyance belt 113 to the first suction fan 1143 when the first suction fan 1143 suctions air. Instead of the support plate with the artificial permeable holes, a porous body may be used.

The recorder 12 is disposed in the downstream of the heating chamber 605 in the conveyance direction of the recording medium P. The recorder 12 includes nozzles from each of which ink is jetted. The recorder 12 has a nozzle opening face in the surface opposed to the outer surface of the conveyance belt 113. The ink is jetted from the openings of the nozzles and landed on the surface (recording face) of the recording medium P opposed to the recorder 12. In the embodiment, the recorder 12 has a line head structure in which the nozzle openings are arranged in the nozzle opening face at predetermined intervals in the width direction perpendicular to the conveyance direction of the recording medium P over a maximum width that corresponds to a maximum recordable size of the ink jet recording apparatus 1 of the embodiment. That is, when ink is jetted, the recorder 12 is fixed relative to the conveyance belt 113. The ink is successively jetted from the nozzles while the recording medium P is being moved in the conveyance direction, so that a two-dimensional image can be recorded.

The recorder 12 includes the head units 12Y, 12M, 12C and 12K corresponding respectively to types (colors) of ink, i.e. four colors of Y (yellow), M (magenta), C (cyan) and K (black). The head units 12Y, 12M, 12C and 12K sequentially jet the respective types of ink to the recording medium P. In addition to the four color inks, other inks such as color inks of orange, green, violet, red, blue and white (specific color ink compositions), light color ink compositions, dark color ink compositions and/or a transparent ink composition may be used/added, and the recorder 12 may jet them on the recording medium P. The ink to be jetted in the embodiment is UV-curable ink that stably cures when it is irradiated with ultraviolet ray (predetermined energy ray).

The second conveyer 21 receives the recording medium P from the first conveyer 11 and conveys the recording medium P through an ultraviolet ray irradiation area of the fixer 23. The second conveyer 21 includes a driving roller 211, a driven roller 212, an endless conveyance belt 213 (second conveying member), a second suction holder 214, pressing rollers 215, 216, a second pressing motor 217, a cooler 24 and the like. Except that two pressing rollers 215, 216 are provided instead of the pressing roller 115 and the cooler 24 are further provided, the configuration of these components is the same as that of the driving roller 111 (and the moving amount meter), the driven roller 112, the conveyance belt 113, the first suction holder 114 and the second pressing motor 217 of the first conveyer 11, and the detailed description thereof is omitted.

The pressing rollers 215, 216 respectively press opposite ends in the width direction of the recording medium P. At the time the recording medium P is passed to the second conveyer 21, the ink has been jetted from the recorder 12 to the recording medium P on the first conveyer 11 but has not been fixed yet. The pressing roller 215, 216 press only margins at both ends in the width direction so that they do not press a part with the ink to spread it. The position of the pressing rollers 215, 216 in the width direction is changeable by a user and/or a control of a hardware processor 40.

A section (second plane) of outer surface (mounting surface) of the conveyance belt 213 where the recording medium P is mounted and moved horizontally is at the same level as the section of the outer surface (mounting surface) of the conveyance belt 113 where the recording medium P is mounted and moved horizontally. Since the recording medium P is directly passed from the conveyance belt 113 to the conveyance belt 213, the level of the recording medium P is not changed, and the recording medium P is conveyed in a single plane.

As used herein, being at the same level is not limited in a strict sense but only requires such a precision that are achieved by visual alignment in a typical assembling process of a mechanical device. For example, the allowance is approximately 1 cm, preferably 1 mm.

The fixer 23 fixes the ink on the recording medium P conveyed from the conveyance belt 213. The fixer 23, which includes an emitter of ultraviolet ray, irradiates the UV-curable ink on the recording medium P with ultraviolet ray.

It is preferred that the ultraviolet is emitted from the fixer 23 to the recording medium P uniformly (without large variation in intensity) in the section where the recording medium P is mounted on the mounting surface of the conveyance belt 213. To reduce the intensity of the ultraviolet ray that leaks from the section, a light shielding plate 231 is provided to cover the surrounding of the area that is irradiated with ultraviolet ray by the fixer 23.

Depending on the type of ink or the like, at least the UV irradiation area in the mounting surface of the conveyance belt 213 and the fixer 23 may be housed in a case, and the case (or the area covered with the light shielding plate 231 where the case is not provided) may filled with a specific gas such as nitrogen gas in order to improve the effect of the fixation. In this case, circulation cooling of the specific gas or cooling of the case may be suitably performed in order to prevent accumulation of heat in the case (light shielding plate 231).

The cooler 24 cools the conveyance belt 213 that is heated due to heat generation in the fixation of the ink onto the recording medium P by the fixer 23 and the heat generation of the fixer 23 itself. For example, the cooler 24 includes a cooling fan. The cooling fan cools the conveyance belt 213 by the air. The cooler 24 is opposed to the mounting surface of the conveyance belt 213 in the section where the recording medium P is not mounted on the mounting surface.

In the embodiment, the cooler 24 is configured to cool the conveyance belt 213. However, it may also be configured to cool the UV emitter of the fixer 23 so as to prevent overheating of the emitter in prolonged image recording.

The third conveyer 31 includes a driving roller 311, a driven roller 312, an endless conveyance belt 313 (third conveyance member), a third suction holder 314, a pressing roller 315, a third pressing motor 317 and the like. The third conveyer 31 receives the recording medium P conveyed from the second conveyer 21 and passes it through a reading area of the reader 35. The configuration of the driving roller 311, the driven roller 312 and the conveyance belt 313 is the same as that of the driving roller 111 (and the moving amount meter), the driven roller 112, the conveyance belt 113, the first suction holder 114, the pressing roller 115 and the first pressing motor 117, and the detailed description thereof is omitted.

The section (third plane) of the outer surface (mounting surface) of the conveyance belt 313 where the recording medium P is mounted and moved horizontally is at the same level as the section of the outer surface (mounting surface) of the conveyance belt 213 where the recording medium P is mounted. The recording medium P is directly passed from the mounting surface of the conveyance belt 213 to the mounting surface of the conveyance belt 313 in the same plane. That is, after the recording medium P is mounted on the conveyance belt 113 of the first conveyer 11 until it is removed from the conveyance belt 313 of the third conveyer 31, it is moved and passed in a single plane.

The reader 35 reads the recording face of the recording medium P that is conveyed by the conveyance belt 313. For example, the reader 35 includes an imaging unit such as a line sensor. The line sensor (imaging unit) includes imaging elements that are opposed to the mounting surface of the conveyance belt 313 and aligned over the ink jetting width of the recorder 12. The line sensor captures a one-dimensional image. By repeatedly capturing images at intervals corresponding to the conveyance speed of the recording medium P (i.e. the measurement values of the encoders of the conveyer 11, 21, 31 and the elapsed time), the line sensor can obtain a two-dimensional image.

Figure 3:
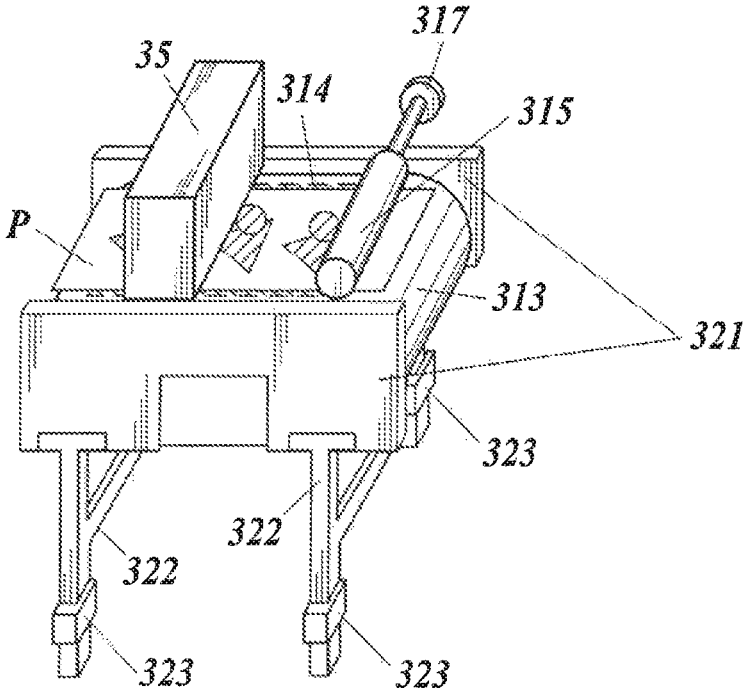
FIG. 3 is a perspective view of a third conveyer and a leg thereof.

FIG. 3 is a perspective view of the third conveyer 31 and the frame thereof.

The third conveyer 31 is surrounded by fences 321 at both ends in the width direction perpendicular to the conveyance direction of the recording medium P. The third conveyer 31 is supported with respect to a floor surface by legs 322 that extend vertically downward from the fences 321. The legs 322 are provided with adjusters 323 for adjusting the height. The user can adjust the height so that the third conveyer 31 is at the same level as the conveyance surface of the adjacent second conveyer 21. The first conveyer 11 and the second conveyer 21 may have the same configuration.

In the embodiment, the adjusters 323 are manually operated by the user. Instead, they may include lack rails, gears and the like so that adjustment can be made by electrically moving the gears. The target position of the adjustment may be either manually set by the user or automatically set by using a sensor that detects the level difference from the adjacent conveyance surface.

The medium ejector 55 stores the recording medium P conveyed from the third conveyer 31 until the user collects it. The medium ejector 55 includes an ejection tray 551 (plate) on which recording media P with an image recorded thereon are sequentially stacked. The ejection tray 551 is at a level lower than the conveyance surface of the third conveyer 31 so that the recording medium P on the conveyance surface can be ejected. Further, the ejection tray 551 may be movable in the vertical direction according to the amount of recording media P stored thereon.

The above-described conveyance belts 113, 213, 313 constitute the conveyance members.

In the first conveyer 11, the first suction holder 114 and the pressing roller 115 constitute an anti-floating unit. The second suction holder 214 and the pressing rollers 215, 216 constitute an anti-floating unit of the second conveyer 21. The third suction holder 314 and the pressing roller 315 constitute an anti-floating unit of the third conveyer 31.

The longer the length of the sections of the first conveyer 11, the second conveyer 21 and the third conveyer 31 where the recording medium P is mounted on the conveyance belts 113, 213, 313, the more stable the recording medium P. This is because when there are margins with considerable length before and after the components for the respective functions (recording, fixing, reading) in the conveyers, the recording medium P neither step over a gap between the conveyers nor is released from the conveyance surfaces between the functions (mainly between recording and reading), which can reduce or prevent a deterioration in positional precision due to the bent or folded recording medium P or the changing conveyance speed. On the other hand, when these sections are long, it is required to secure a room in the ink jet recording apparatus 1 according to the length (conveyance distance) of the sections. Further, the longer sections require the higher operating power, i.e. consumes more power according to the extended conveyance distance, and the precision (expansion, shrinkage, the uniformity of the moving speed and the like) is deteriorated according to the length of the sections. Therefore, the sections are not extended longer than necessary, and the length of the sections is selected in balance. For example, the length and the position of the sections may be selected so that the heating roller 601 is not in contact with the recording medium P at the time when an image starts to be recorded on the recording medium P on the mounting surface of the first conveyer 11, and/or the recording medium P is not in contact with the conveyance belt 213 of the second conveyer 21 at the time of finishing the image recording.

Figure 4:
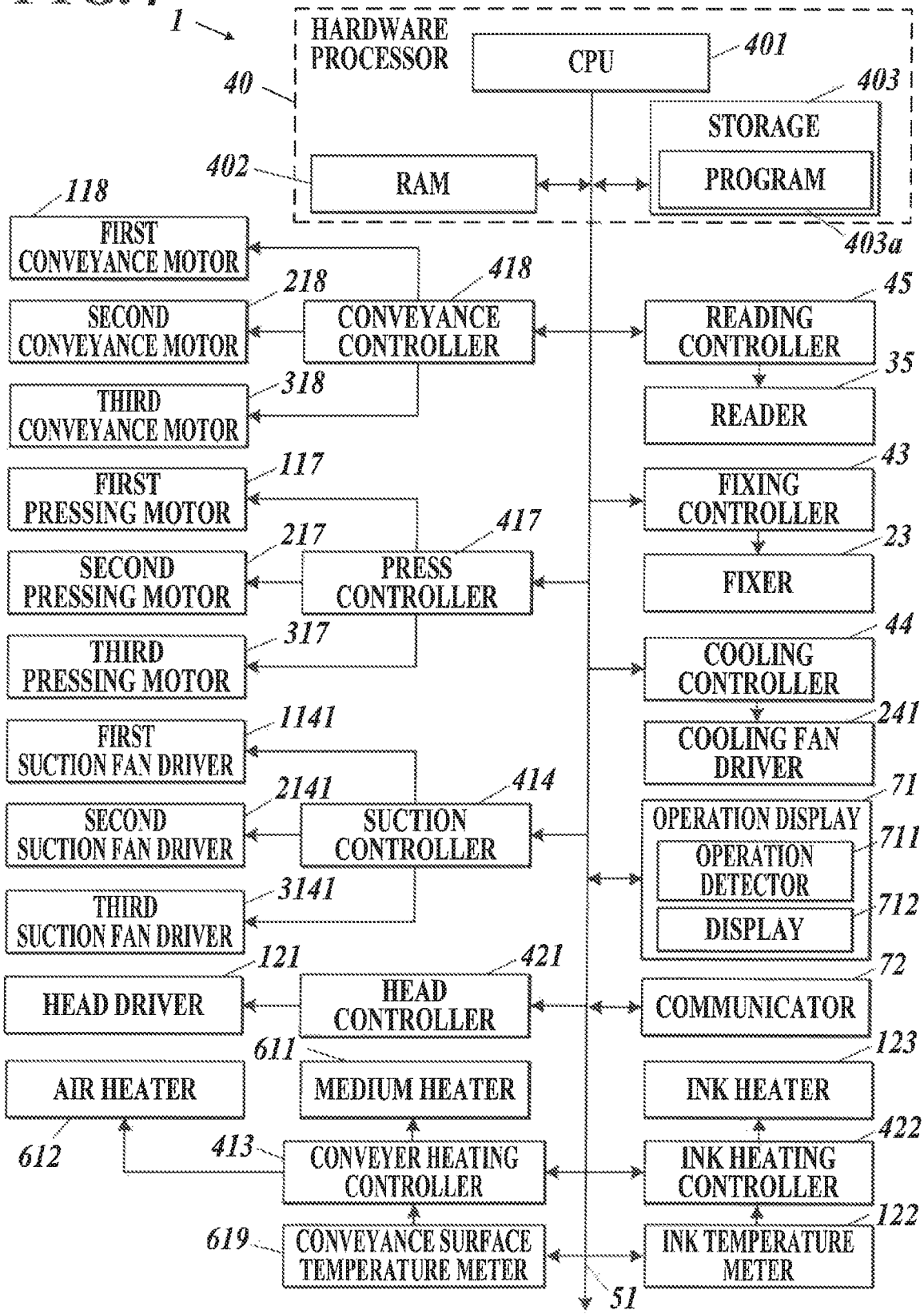
FIG. 4 is a block diagram of the functional configuration of the ink jet recording apparatus.

FIG. 4 is a block diagram of the functional configuration of the ink jet recording apparatus 1 according to the embodiment.

The ink jet recording apparatus 1 includes: the hardware processor 40; a first conveyance motor 118, a second conveyance motor 218, a third conveyance motor 318 and a conveyance controller 418; a first pressing motor 117, a second pressing motor 217, a third pressing motor 317 and a press controller 417; a first suction fan driver 1141, a second suction fan driver 2141, a third suction fan driver 3141 and a suction controller 414; a head driver 121 and a head controller 421; a medium heating element 611, an air heating element 612, a conveyance surface temperature meter 619, a conveyer heating controller 413; an ink heater 123, an ink temperature meter 122 and an ink heating controller 422; a fixer 23 and a fixation controller 43; a cooling controller 44 and a cooling fan driver 241; a reader 35 and a reading controller 45; an operation display 71; a communicator 72 and the like.

The conveyance controller 418, the press controller 417, a suction controller 414, a head controller 421, the conveyer heating controller 413, the ink heating controller 422, the reading controller 45, the fixation controller 43 and the cooling controller 44 are referred to as individual operation controllers. The individual operation controllers may be constituted by the hardware structure of the hardware processor 40 or respective dedicated CPUs, memories, theoretical circuits and the like.

The hardware processor 40 includes a CPU (Central Processing Unit) 401, a RAM (Random Access Memory) 402, a storage 403 and the like. The hardware processor 40 reads a controlling program 403*a* and setting data from the storage 403 and temporarily stores them in the RAM 402, and the CPU 401 performs control processing based on the temporary data. The storage 403 includes a non-volatile memory that is repeatedly readable and writable, and an auxiliary storage such as an HDD (Hard Disk Drive). The storage 403 may be partly constituted by a ROM that is only readable.

The hardware processor 40 (CPU 401) integrally controls the operation of the ink jet recording apparatus 1. The hardware processor 40 controls the operation of the components of the ink jet recording apparatus 1 by using the individual operation controllers according to an instruction relating to image recording and the recording image data thereof input from an external device through the communicator 72, i.e. a print job.

The operation display 71 receives user operations or displays status information, an operation menu and the like to the user. The operation display 71 includes an operation detector 711 as an operation receiver and a display 712. For example, the display 712 includes a display panel such as an LCD (Liquid Crystal Display). The display 712 displays various information on the LCD according to a control signal from the hardware processor 40. For example, the operation detector 711 includes a touch sensor that is overlaid on the LCD. The operation detector 711 detects an operation at a coordinate corresponding to the screen on the LCD and outputs a detection signal to the hardware processor 40.

The communicator 72 is an interface that communicates with an external device such as an PC to perform data communication according to a variety of communication standards. For example, the communicator 72 is constituted by a network card for LAN connection or a radio frequency communication interface for BLUETOOTH (registered trademark) communication or the like. Alternatively, the communicator 72 may be constituted by a connection terminal and a driver for direct connection with an external device through USB. The hardware processor 40 retrieves a print job and a variety of control setting data for the ink jet recording apparatus 1 from an external device through a communicator 72.

The head driver 121 supplies electric power to loads (piezoelectric elements of a piezoelectric ink jet recording apparatus or heating elements of a thermal ink jet recording apparatus) of the head units 12Y, 12M, 12C, 12K at suitable timing according to a control signal from the head controller 421 and recording image data so that ink is ejected from openings of the nozzles.

The cooling fan driver 241 is controlled by the cooling controller 44 to rotate a cooling fan of the cooler 24 at a suitable rotation speed.

The first suction fan driver 1141 is controlled by the suction controller 414 to rotate a first suction fan of the first suction holder 114 at a suitable rotation speed.

The second suction fan driver 2141 is controlled by the suction controller 414 to rotate a second suction fan of the second suction holder 214 at a suitable rotation speed.

The third suction fan driver 3141 is controlled by the suction controller 414 to rotate a third suction fan of the third suction holder 314 at a suitable rotation speed.

The medium heating element 611 is controlled by the conveyer heating controller 413 to heat the recording medium P via the surface of the heating roller 601 so that the temperature of the recording medium P is within a suitable temperature range when the ink is landed. The air heating element 612 heats the heating chamber 605 to a suitable temperature. The ink heater 123 is controlled by the ink heating controller 422 to heat ink channels and surrounding components so that the ink is supplied to the head units 12Y, 12M, 12C, 12K and ejected at a suitable temperature.

In order to suitably maintain the heating conditions by the medium heating element 611, the air heating element 612 and the ink heater 123, the conveyance surface temperature meter 619 and the ink temperature meter 122 measure the surface temperature of the conveyance belt 113 or the recording medium P mounted on the conveyance belt 113 and the temperature of the ink channels or the ink in the ink channels and output the measurement results respectively to the conveyer heating controller 413 and the ink heating controller 422.

The conveyance surface temperature meter 619 and the conveyer heating controller 413 may be a part of a temperature adjuster.

The conveyance controller 418 controls the operation of the first conveyance motor 118, the second conveyance motor 218 and the third conveyance motor 318 to convey the recording medium P at suitable speed. In this regard, it is necessary that the conveyance speed of the conveyers 11, 21, 31 and the heating roller 601 of the medium heater 60 is suitably maintained. The conveyance speed is uniform at all of these components or is slightly faster (by 1% or less) at least in the downstream in the conveyance direction.

The press controller 417 controls the operation of the first pressing motor 117, the second pressing motor 217 and the third pressing motor 317 so as to mount the recording medium P respectively on the outer surface of the conveyance belt 113 of the first conveyer 11, the outer surface of the conveyance belt 213 of the second conveyer 21 and the outer surface of the conveyance belt 313 of the third conveyer 31 while preventing the recording medium P from having a winkle or floating.

The reading controller 45 controls the operation of the reader 35 according to the conveyance timing and speed of the recording medium P to capture a suitable part of the image recorded on the recording medium P.

The fixation controller 43 controls the operation of the fixer 23 to fix the ink of the image on the recording medium P.

In the ink jet recording apparatus 1 of the embodiment, as described above, the recording medium P is passed between the conveyance belts 113, 213, 313 of the conveyers 11, 21, 31 for the respective functional components while the recording medium P is being conveyed. Accordingly, they have to be disposed in a suitable positional relationship in assembling the apparatus, and the timing of operating the functional components has to be suitably selected. The positional precision in assembling the apparatus is by far lower than the required positional precision (e.g. 20 μm) for controlling the ink jetting position. In the embodiment, the timing of feeding the recording medium P from the medium feeder 50 and the distance and the speed between the recording position of the recorder 12 and the reading position of the reader 35 are respectively determined based on the elapsed time when predetermined test images, which are formed at intervals in the conveyance direction or at different positions in the conveyance direction on the conveyance belt 113 of the first conveyer 11, and the upper and lower ends of the recording medium P are read on the conveyance belt 313 of the third conveyer 31 by the reader 35 and based on the measurement values of the above-described moving amount meters (encoders) of the conveyers 11, 21, 31. Alternatively, the positioner 502 and the conveyers 11, 31 (and the second conveyer 21 according to need) may include respective detection sensors for detecting the recording medium P. The determined distances and data on the deviation of speed and the like are stored in the storage 403 and are corrected according to need. By using them, the position and the timing are adjusted at high precision.

When there is a failure in jetting ink from the nozzles in the image recording operation of the test images, it is impossible to perform the setting accurately. Therefore, the determination of the distances and the like and detection of such a failure in the operation may be performed in parallel.

Figure 5:
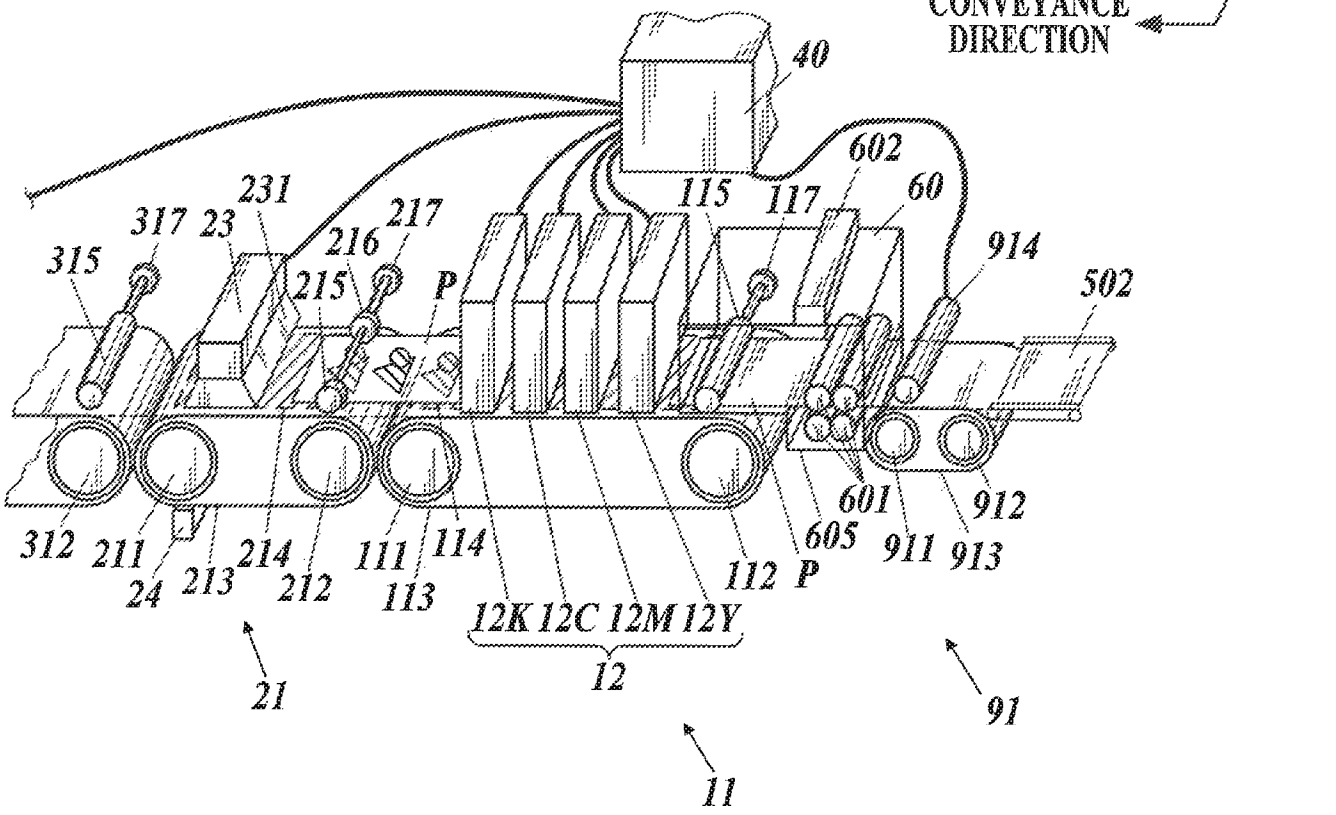
FIG. 5 illustrates a part of a variation of the ink jet recording apparatus according to the embodiment.

FIG. 5 illustrates a part of an ink jet recording apparatus according to a variation of the embodiment.

The ink jet recording apparatus 1*a* of the variation includes a corona treatment unit between the positioner 502 of the medium feeder 50 and the heating chamber 605 of the medium heater 60.

The corona treatment unit includes a fourth conveyer 91, an electrode 914 and the like. The fourth conveyer 91 includes a driving roller 911 and a driven roller 912, a conveyance belt 913 suspended between them, and the like. The conveyance belt 913 is grounded so that a high potential difference from the electrode 914 is created to cause corona discharge. Particularly when the recording medium P is not suitable for fixation of ink, e.g. a type of resin sheet or the like, this configuration allows performing a surface modification by a corona treatment so as to make the surface of the sheet suitable for image recording with ink. In this configuration, the corona treatment unit may be sealed in a case so that the case can be filled with a specific atmosphere according to need.

In such cases, the conveyance surface for the recording medium P of the fourth conveyer 91 is flush with the conveyance surface of the medium heater 60, the first conveyer 11 and the like.

As described above, the ink jet recording apparatus 1 or 1*a* of the embodiment includes: the conveyers 11, 21, 31 that convey the recording medium P by using the conveyance belts 113, 213, 313 on which the recording P is mounted; the recorder 12 which jets ink onto the conveyed recording medium P; and the fixer 23 that fixes the ink landed on the recording medium P. The recorder 12 jets the ink that is curable by ultraviolet ray. The fixer 23 irradiates the ink on the recording medium P with ultraviolet ray. The conveyers 11, 21, 31 pass the conveying recording medium P between the conveyance belts 113, 213, 313 and move the recording medium P in respective planes by the movement of the conveyance belts 113, 213, 313. The conveyers 11, 21, 31 move the recording medium P mounted on the conveyance belt 113 of the conveyance belts in the predetermined first plane by the movement of the conveyance belt 113 while the recording medium P is opposed to the ink jetting surface of the recorder 12, and mount the recording medium P, which has been moved by the conveyance belt 113, onto the conveyance belt 213 and to further move it in the predetermined second plane by the movement of the conveyance belt 213 to pass it through the irradiation area of ultraviolet ray of the fixer 23.

As described above, the ink jet recording apparatus 1, which conveys the recording medium P in a plane with the endless belts and the like, includes two or more units of conveyers. In particular, the second conveyer 21 for the operation of the fixer 23 is separated from the first conveyer 11 for image recording. This can prevent the image recording from being affected by the heat generation by the reaction of ultraviolet ray (energy ray) and the ink in the fixer 23 and the heat generation in the components for emitting the energy ray, and thereby allows recording an image in a more suitable environment. Therefore, with the ink jet recording apparatus 1, it is possible to record an image with suitable image quality on the recording medium P more stably and to fix the image more surely.

Since the conveyers are structured as units, it is possible to configure an ink jet recording apparatus by using only conveyers that correspond to functional components necessary for the usage or the like.

Since the conveyance belts can be replaced individually, it is possible to reduce the cost for replacement when a part of them are damaged or deteriorated.

Further, the configuration of the present invention can prevent the flow of a specific gas leaked from the case covering the fixer 23 or the area inside the light shielding plate 231 (the light shielded area) or the air flow for cooling the light emitter from being directed along the conveyance belts directly into the gap between the nozzle surface of the recorder 12 and the recording medium P so as to deviate the landing position of flying ink.

The ink jet recording apparatus 1 includes the reader 35 that reads the recording face of the recording medium P that is opposed to the ink jetting surface of the recorder 12. After moving the recording medium P by the movement of the conveyance belt 213, the conveyers 11, 21, 31 mounts the recording medium P onto the conveyance belt 313 and moves it in the predetermined third plane by the movement of the conveyance belt 313 so as to pass it through the reading area of the reader 35.

As described above, the second conveyer 21 for the operation of the fixer 23 is further separated from the third conveyer 31 for reading the recorded image. This can prevent the image reading operation from being affected by the heat generation by the operation of the fixer 23. Further, since the length of the individual conveyance belts is short compared to the number of functional components, it is possible to improve the positional precision of the recording medium P compared to the case in which a long single conveyance belt is used.

The conveyers 11, 21, 31 include the adjuster (the adjuster 323 of the conveyer 31) that adjusts the position of the planes in which the recording medium P is moved by the movement of the conveyance belts 113, 213, 313. This allows suitably adjusting the level of the conveyance surface when the ink jet recording apparatus 1 is installed or moved.

The respective planes of the conveyance belts 113, 213, 313 in which the recording medium P is moved are aligned in a single plane. That is, even when the conveyer is composed of two or move divided conveyance belts, the recording medium P is simply conveyed in a predetermined plane by the conveyance belts. Accordingly, the recording medium P can be passed more reliably with the simplified configuration for passing the recording medium P. Further, deterioration of the positional precision caused by passing the recording medium P can be reduced. Further, the occurrence of misalignment and the like in passing the recording medium P can be reduced. In particular, when a misalignment occurs between the image recording and the image reading particularly in the rotating direction, it takes a lot of labor to read an image at the correct position. Since the conveyance belts are disposed in the relative positional relationship in which the recording medium P can be passed readily and reliably, the occurrence of misalignment and the relevant labor in reading an image are not increased.

Since the recording medium P is passed between the conveyance belts 113, 213, 313 in the single plane, the recording medium P does not have to be conveyed along a curve (curved surface) or three-dimensionally. This can reduce the occurrence of misalignment or the like in passing the recording medium P. In particular, when misalignment occurs between the image recording and the image reading particularly in the rotating direction, it takes a lot of labor to read an image at the correct position. Since the conveyance belts are disposed in the relative positional relationship in which the recording medium P can be passed readily and reliably, the occurrence of misalignment and the relevant labor in reading an image are not increased.

When the medium feeder 50 is configured to sequentially feed flat recording media with a specific size to the first conveyer 11, particularly heavy paper or cardboard that is favorably conveyed in a plane, so that the recording media are fed individually, the advantageous effects such as easier and more reliable pass of the recording media and reduced misalignment are more remarkable.

The conveyers 11, 21, 31 include the pressing rollers 115, 215, 216, 315, the first suction holder 114, the second suction holder 214, the third suction holder 314 and the like that prevent the recording medium P from separating (floating) from the conveyance belts 113, 213, 313.

With this configuration, the recording medium can be suitably mounted, and the functional operations can be performed in a correct position although there are the separate conveyance belts.

The conveyers 11, 21, 31 include suction fans for holding the recording medium P on the conveyance belts (first suction fan 1143 for holding the recording medium P on the conveyance belt 113, and the like). With this configuration, the recording medium P is suitably held by suctioning air. Further, the recording medium P can be rapidly and surely released by stopping the suction.

The conveyance belts 113, 213, 313 includes the respective mounting surfaces on which the recording medium P is mounted, and the through openings that connect the mounting surfaces to the opposite surfaces, and the suction holders suction air at the mounting surfaces from the opposite surfaces through the openings so as to hold the recording medium P on the conveyance belts 113, 213, 313. With this configuration, the recording medium P can be held in a plane on the mounting surfaces of the conveyance belts more readily and more surely when the recording P is conveyed.

The ink jet recording apparatus 1 includes the pressing rollers 115, 215, 216, 315 that press the recording medium P against the conveyance belts 113, 213, 313. This configuration can prevent the occurrence of a situation in which the recording medium P floats at the time of mounting the recording medium P and is therefore not held surely.

The ink jet recording apparatus 1 includes the medium heater 60 that controls the temperature of the recording medium P before the recording medium P is mounted on the conveyance belt 113. Accordingly, the temperature can be controlled so that the ink can be suitably landed and fixed on the recording medium P. As a result, an image can be recorded in a suitable condition.

The ink jet recording apparatus 1 includes the corona treatment unit that performs a corona treatment on the recording medium P in the upstream in the conveyance direction of the recording medium P with respect to the point where the recording medium P is mounted on the conveyance belt 113. With this configuration, when the recording medium P is a resin sheet or the like on which the ink cannot be suitably fixed without a treatment, it is possible to suitably modify the surface so that an image is suitably recorded with the ink. Since the conveyer 91 conveys the recording medium P in the above-described single plane, the occurrence of an error or misalignment in passing the recording medium P can be reduced. Accordingly the recording medium P can be conveyed reliably.

The conveyance belts 113, 213, 313 are respectively individual endless belts. Therefore, it is possible to readily revolve them to convey two or more recording media P sequentially in the plane.

At least a part of the conveyance belts 113, 213, 313 is a steel belt. Even when a high-precision steel belt is used, which is highly heat-conductive, the influence of heat generation by the fixation and the operation of the fixer 23 can be reduced more surely. Accordingly, the conveyance position can be controlled at higher precision.

The present invention is not limited to the above-described embodiment, and a variety of changes can be made.

For example, the above-described embodiment is an example in which the ink jet recording apparatus 1 includes the first conveyer 11 for the operation of the recorder 12, the second conveyer 21 for the operation of the fixer 23 and the third conveyer 31 for the operation of the reader 35. Further, the variation thereof is an example in which the ink jet recording apparatus 1 further includes the additional fourth conveyer 91 for the corona treatment. However, the present invention is not limited thereto. For example, the reader 35 and the third conveyer 31 may not be provided, or another functional component and another conveyer therefor may be provided in any position.

The above-described embodiment is an example in which the first plane, the second plane and the third plane are flush in the same plane. However, the present invention is not limited thereto. For example, in order to further reduce the amount of ultraviolet ray of the fixer 23 that is leaked to the other conveyance surfaces, a step may be formed between the conveyers. In this case, a component for passing the recording medium may be suitably added so that the recording medium is suitably passed.

In the above-described embodiment, a cardboard is given as an example of the recording medium P. However, the recording medium P is not limited thereto. When the recording medium is easily bendable, such as normal recording paper, a guide may be provided so that the recording medium is readily released from an upstream conveyance belt at the boundary between the conveyance belts. Alternatively, air may be blown through the openings of the conveyance belts instead of suctioning air so that the recording medium is floated.

In the above-described embodiment, the UV-curable ink is used, and the ink landed on the recording medium P is irradiated with ultraviolet ray to cure and fix it. Instead, a different type of ink that cures by other energy ray may be used. In this case, the fixer 23 may emit the energy ray that can cure the ink.

In the above-described embodiment, the medium heater 60 serves as a temperature controller to heat he recording medium P. However, when it is necessary to cool the recording medium P, a component for cooling it is included in the temperature controller.

In the above-described embodiment, individual recording media are sequentially fed to record an image. Instead, the ink jet recording apparatus of the present invention may be used in a configuration in which images are recorded at predetermined intervals on a continuous recording medium, and it may be then cut and separated in a post treatment.

The above described embodiment is an example in which the pressing rollers are combined with air-suctioning to hold the recording medium P on the conveyance belts in order to prevent the recording medium P from floating. However, the present invention is not limited thereto. For example, non-rotary fixed guide members may be used instead of the pressing rollers, or the recording medium P may be held by means of electrostatic force or the like instead of the air-suctioning.

In the above-described embodiment, the recording medium is conveyed by the conveyers that are separated corresponding to the respective functional components. However, the operations of two or more functional components may be performed on a single conveyer as long as heat conduction from the fixer or the like is suitably prevented.

Specific details of the above-described embodiment such as the configuration, the structure, the arrangement and the sequence thereof can be suitably changed without departing from the features of the present invention.

Although embodiments of the present invention have been described and illustrated in detail, the disclosed embodiments are made for purposes of illustration and example only and not limitation. The scope of the present invention should be interpreted by terms of the appended claims.

INDUSTRIAL APPLICABILITY

The present invention is applicable to ink jet recording apparatuses.

REFERENCE SIGNS LIST

1, 1*a* Ink jet recording apparatus
11 First conveyer
111 Driving roller
112 Driven roller
113 Conveyance belt
114 First suction holder
1141 First suction fan driver
1142 Support plate
1143 First suction fan
115 Pressing roller
117 First pressing motor
118 First conveyance motor
12 Recorder
12Y, 12M, 12C, 12K Head unit
121 Head driver
122 Ink temperature meter
123 Ink heater
21 Second conveyer
211 Driving roller
212 Driven roller
213 Conveyance belt
214 Second suction holder
2141 Second suction fan driver
215, 216 Pressing roller
217 Second pressing motor
218 Second conveyance motor
23 Fixer
231 Light shielding plate
24 Cooler
241 Cooling fan driver
31 Third conveyer
311 Driving roller
312 Driven roller
313 Conveyance belt
314 Third suction holder
3141 Third suction fan driver
315 Pressing roller
317 Third pressing motor
318 Third conveyance motor
321 Fence
322 Leg
323 Adjuster
35 Reader
40 Hardware processor
401 CPU
402 RAM
403 Storage
403*a* Program
413 Conveyer heating controller
414 Suction controller
417 Press controller
418 Conveyance controller
421 Head controller
422 Ink heating controller
43 Fixation controller
44 Cooling controller
45 Reading controller
50 Medium feeder
501 Medium loader
502 Positioner
55 Medium ejector
551 Ejection tray
60 Medium heater
601 Heating roller
605 Heating chamber
611 Medium heating element
612 Air heating element
619 Conveyance surface temperature meter
71 Operation display
711 Operation detector
712 Display
72 Communicator
91 Conveyer

911 Driving roller
912 Driven roller
913 Conveyance belt
914 Electrode
P Recording medium

The invention claimed is:

1. An ink jet recording apparatus, comprising:

a conveyer which sequentially conveys individual recording media with a specified size, the conveyer having conveyance members on which the recording media are mounted;

a medium feeder which sequentially feeds the individual recording media with the specified size to the conveyer;

a recorder which jets ink onto the recording media being conveyed; and a fixer which fixes the ink landed on the recording media;

wherein the ink jetted from the recorder is curable by a predetermined energy ray, wherein the fixer irradiates the ink on the recording media with the predetermined energy ray, and wherein the conveyer passes the recording media for conveyance between the conveyance members and moves the recording media in respective planes by movement of the conveyance members;

moves and supports the recording media mounted on a first conveyance member of the conveyance members in a predetermined first plane by a movement of the first conveyance member while the recording media is opposed to an ink jetting surface of the recorder;

mounts the recording media which has been moved by the first conveyance member onto a second conveyance member of the conveyance members and moves and supports the recording media in a predetermined second plane by a movement of the second conveyance member to pass the recording media through an irradiation area of the predetermined energy ray of the fixer.

2. The ink jet recording apparatus according to claim 1, further comprising:

a reader which reads a recording face of the recording media opposed to the ink jetting surface, wherein the conveyer mounts the recording media which has been moved by the movement of the second conveyance member onto a third conveyance member of the conveyance members and moves the recording media in a predetermined third plane by a movement of the third conveyance member to pass the recording media through a reading area of the reader.

3. The ink jet recording apparatus according to claim 1, wherein the conveyer comprises an adjuster which adjusts the position of the planes in which the recording media are moved by the movement of the conveyance members.

4. The ink jet recording apparatus according to claim 1, wherein the planes in which the recording media are moved by the movement of the conveyance members are flush in a single plane.

5. The ink jet recording apparatus according to claim 4, wherein the recording media are passed between the conveyance members in the single plane.

6. The ink jet recording apparatus according to claim 1, wherein the conveyer comprises an anti-floating unit which prevents the mounted recording media from floating from the conveyance members.

7. The ink jet recording apparatus according to claim 6, wherein the anti-floating unit comprises a suction unit which suctions and holds the recording media on the conveyance members.

8. The ink jet recording apparatus according to claim 7, wherein the conveyance members respectively comprise mounting surfaces on which the recording media are mounted, and through openings that connect the mounting surfaces and opposite surfaces, and wherein the suction unit suctions air at the mounting surfaces from the opposite surfaces through the openings so as to hold the recording media on the conveyance members.

9. The ink jet recording apparatus according to claim 6, wherein the anti-floating unit comprises a roller that presses the recording media against the conveyance members.

10. The ink jet recording apparatus according to claim 1, further comprising:

a temperature controller which controls a temperature of the recording media before the recording media are mounted on the first conveyance member.

11. The ink jet recording apparatus according to claim 1, further comprising:

a corona treatment unit which performs a corona treatment on the recording media and which is disposed in an upstream in a conveyance direction of the recording media with respect to a point where the recording media are mounted on the first conveyance member.

12. The ink jet recording apparatus according to claim 1, wherein the conveyance members are constituted by respective individual endless belts.

13. The ink jet recording apparatus according to claim 12, wherein at least a part of the endless belts is a steel belt.

14. An ink jet recording apparatus, comprising:

a conveyer which conveys a recording medium, the conveyer having conveyance members on which the recording medium is mounted;

a recorder which jets ink onto the recording medium being conveyed;

a fixer which fixes the ink landed on the recording medium; and a reader which reads a recording face of the recording medium opposed to the ink jetting surface;

wherein the ink jetted from the recorder is curable by a predetermined energy ray, wherein the fixer irradiates the ink on the recording medium with the predetermined energy ray, and wherein the conveyer passes the recording medium for conveyance between the conveyance members and moves the recording medium in respective planes by movement of the conveyance members;

moves the recording medium mounted on a first conveyance member of the conveyance members in a predetermined first plane by a movement of the first conveyance member while the recording medium is opposed to an ink jetting surface of the recorder;

mounts the recording medium which has been moved by the first conveyance member onto a second conveyance member of the conveyance members and moves the recording medium in a predetermined second plane by a movement of the second conveyance member to pass the recording medium through an irradiation area of the predetermined energy ray of the fixer; and mounts the recording medium which has been moved by the movement of the second conveyance member onto a third conveyance member of the conveyance members and moves the recording medium in a predetermined third plane by a movement of the third conveyance member to pass the recording medium through a reading area of the reader.

15. The ink jet recording apparatus according to claim 14, wherein the conveyer comprises an adjuster which adjusts the position of the planes in which the recording medium is moved by the movement of the conveyance members.

16. The ink jet recording apparatus according to claim 14, wherein the planes in which the recording medium is moved by the movement of the conveyance members are flush in a single plane.

17. The ink jet recording apparatus according to claim 14, further comprising:

a medium feeder which sequentially feeds recording media with a specified size to the conveyer.

18. The ink jet recording apparatus according to claim 14, wherein the conveyer comprises an anti-floating unit which prevents the mounted recording medium from floating from the conveyance members.

19. The ink jet recording apparatus according to claim 14, further comprising:

a temperature controller which controls a temperature of the recording medium before the recording medium is mounted on the first conveyance member.

20. The ink jet recording apparatus according to claim 14, further comprising:

a corona treatment unit which performs a corona treatment on the recording medium and which is disposed in an upstream in a conveyance direction of the recording medium with respect to a point where the recording medium is mounted on the first conveyance member.

* * * * *